US010182616B2

(12) United States Patent
O'Brien

(10) Patent No.: US 10,182,616 B2
(45) Date of Patent: Jan. 22, 2019

(54) SHOE LINERS AND METHOD FOR MAKING THE SAME

(71) Applicant: Catherine Maureen O'Brien, Altadena, CA (US)

(72) Inventor: Catherine Maureen O'Brien, Altadena, CA (US)

( * ) Notice: Subject to any disclaimer, the term of this patent is extended or adjusted under 35 U.S.C. 154(b) by 0 days.

(21) Appl. No.: 14/488,189

(22) Filed: Sep. 16, 2014

(65) Prior Publication Data

US 2015/0230551 A1 Aug. 20, 2015

Related U.S. Application Data

(60) Provisional application No. 61/941,322, filed on Feb. 18, 2014.

(51) Int. Cl.
*A43B 13/38* (2006.01)
*A43B 17/10* (2006.01)

(52) U.S. Cl.
CPC ..... *A43B 17/105* (2013.01)

(58) Field of Classification Search
CPC ..... A43B 17/18; A43B 17/105; A43B 7/00; A43B 7/125
See application file for complete search history.

(56) References Cited

U.S. PATENT DOCUMENTS 582,670 A * 5/1897 McWilliam ..... A43B 7/142 36/44
1,370,799 A * 3/1921 Egerton ..... A43B 7/142 264/258
1,780,574 A 11/1930 Williams
1,814,518 A * 7/1931 McGrail ..... A43B 23/07 12/146 C
1,926,283 A * 9/1933 Herbert ..... A43B 17/102 36/44
2,061,911 A * 11/1936 Leindorf ..... A43B 1/0045 36/43
2,121,604 A * 6/1938 Semke ..... A43B 17/102 36/44
2,862,313 A * 12/1958 Jones ..... A43B 7/1425 36/145
2,863,231 A * 12/1958 Jones ..... A43B 7/14 36/174
2,865,097 A * 12/1958 Vollrath, Jr. ..... A43B 17/18 12/142 R (Continued)

OTHER PUBLICATIONS

Zeasorb Products: Zeasorb Athlete's Foot. Published: May 10, 2012. Retrieved from web Sep. 14, 2015; http://www.zeasorb.com/products/athletes-foot.html.*

(Continued)

*Primary Examiner* — Richale Quinn
*Assistant Examiner* — Anne Kozak
(74) *Attorney, Agent, or Firm* — R. Dabney Eastham

(57) ABSTRACT

A biodegradable and disposable shoe liner is made of a first layer impregnated with a deodorant and an absorbent, a second layer made of a moisture-resistant material, and an adhesive layer on the bottom side of the second layer for temporary attachment to the foot bed of a shoe. A peel-off layer of paper covers the adhesive layer to prevent the shoe liners from sticking to each other or other objects before use.

13 Claims, 2 Drawing Sheets

(56) References Cited

U.S. PATENT DOCUMENTS 2,911,973 A * 11/1959 Chieffo ..... A43B 17/08 36/3 B
3,344,789 A * 10/1967 Edwin ..... A43B 17/105 604/368
3,442,031 A * 5/1969 Joseph ..... A43B 3/26 12/142 R
3,852,897 A 12/1974 Bridge et al.
4,015,347 A * 4/1977 Morishita ..... A43B 1/0045 36/44
4,099,342 A * 7/1978 Singh ..... A43B 1/0045 36/44
4,192,086 A * 3/1980 Sichak ..... A43B 1/0045 36/3 B
4,223,458 A * 9/1980 Kihara ..... A43B 1/0009 36/44
4,517,308 A * 5/1985 Ehlenz ..... A43B 1/0045 264/45.3
4,685,909 A * 8/1987 Berg ..... A61F 5/4401 536/34
4,703,754 A * 11/1987 Ibbott ..... A43B 17/04 36/44
4,864,740 A * 9/1989 Oakley ..... A43B 17/105 12/142 N
5,035,068 A * 7/1991 Biasi ..... A43B 1/0045 36/141
5,046,604 A * 9/1991 Forhetz ..... A61L 9/01 206/205
5,204,173 A * 4/1993 Canary ..... A43B 13/38 162/129
5,216,825 A * 6/1993 Brum ..... A43B 17/14 36/147
5,388,349 A * 2/1995 Ogden ..... A43B 1/0045 36/43
5,392,533 A 2/1995 Gerhartl
5,607,745 A * 3/1997 Ogden ..... A43B 1/0045 36/3 B
5,727,336 A * 3/1998 Ogden ..... A43B 1/0045 36/43
5,732,485 A * 3/1998 Laughlin ..... A43B 1/0045 36/136
5,753,357 A * 5/1998 Filipitsch ..... A43B 1/0045 36/43
5,799,414 A * 9/1998 Kellerman ..... A43B 1/0072 36/160
5,930,916 A * 8/1999 Connor ..... A43B 1/06 36/11.5
5,935,671 A * 8/1999 Lhuillier ..... A43B 1/0045 36/10
5,980,826 A * 11/1999 Barenberg ..... A23B 4/16 422/37
6,048,810 A * 4/2000 Baychar ..... A41D 27/02 36/117.3
6,176,025 B1 * 1/2001 Patterson ..... A43B 5/001 36/28
6,185,844 B1 * 2/2001 Janzen ..... A43B 17/105 36/3 B
6,453,578 B1 * 9/2002 Yung ..... A43B 7/142 36/166
6,508,015 B1 * 1/2003 Rauch ..... A43B 7/06 36/3 B
6,510,626 B1 * 1/2003 Greenawalt ..... A43B 7/142 36/160
6,631,568 B2 * 10/2003 Howlett ..... A43B 13/181 36/145
6,766,539 B1 * 7/2004 Huber ..... A41B 11/10 2/239
6,915,598 B2 * 7/2005 Grisoni ..... A43B 7/141 36/149
6,959,505 B2 * 11/2005 Poe ..... A43B 1/0009 36/141
7,010,870 B2 * 3/2006 Mick ..... A43B 3/0084 36/44
7,037,571 B2 * 5/2006 Fish ..... A43B 13/02 36/37
7,047,671 B2 * 5/2006 Steed ..... A43B 13/24 36/43
7,314,840 B2 1/2008 Baychar
7,322,130 B2 * 1/2008 Seiter ..... A43B 7/142 36/43
7,373,740 B2 * 5/2008 Lo ..... A43B 7/1415 36/160
7,426,794 B2 * 9/2008 Swensen ..... A43B 7/142 36/145
7,484,319 B2 * 2/2009 Cheskin ..... A43B 7/141 36/144
D627,958 S * 11/2010 Cheskin ..... D2/961
D628,371 S * 12/2010 Yang ..... D2/961
7,854,075 B2 * 12/2010 Kosmas ..... A43B 7/142 36/43
8,151,487 B2 * 4/2012 McLinden ..... A43B 1/0045 36/43
8,256,142 B2 * 9/2012 Igdari ..... A43B 7/142 36/102
8,333,023 B2 * 12/2012 Losio ..... A43B 7/141 12/142 R
8,424,222 B2 * 4/2013 Sulak ..... A43B 7/141 36/174
8,453,346 B2 * 6/2013 Steszyn ..... A43B 7/142 36/146
8,567,098 B2 * 10/2013 Hsu ..... A43B 3/244 36/100
8,745,894 B2 * 6/2014 Cheskin ..... A43B 1/0009 36/3 R
2002/0137420 A1 * 9/2002 Dacey ..... A43B 1/0045 442/389
2003/0009138 A1 * 1/2003 Freeman ..... A43B 1/0045 604/290
2004/0020079 A1 * 2/2004 Klavano ..... A43B 1/0045 36/44
2004/0045189 A1 * 3/2004 Polegato Moretti ... A43B 7/125 36/3 B
2004/0118017 A1 * 6/2004 Dalton ..... A43B 7/142 36/44
2004/0261294 A1 * 12/2004 Kawata ..... A43B 1/0027 36/44
2005/0011084 A1 * 1/2005 Stephenson ..... A43B 1/0045 36/15
2005/0091882 A1 * 5/2005 Tien ..... A43B 1/0045 36/44
2005/0257398 A1 * 11/2005 Blackmer ..... A43B 17/02 36/7.5
2006/0026865 A1 * 2/2006 Grisoni ..... A43B 17/026 36/43
2006/0064896 A1 * 3/2006 Luan ..... A43B 7/34 36/2.6
2006/0123664 A1 * 6/2006 Boyd ..... A43B 7/1425 36/44
2006/0156583 A1 * 7/2006 Butash ..... A43B 13/386 36/44
2006/0207123 A1 * 9/2006 Milner ..... A43B 1/0045 36/44
2007/0033834 A1 * 2/2007 Cheskin ..... A43B 7/141 36/44
2007/0084084 A1 * 4/2007 Rich ..... A43B 7/142 36/44
2007/0119077 A1 * 5/2007 Yoo ..... A43B 1/0045 36/44
2007/0186444 A1 * 8/2007 Hsiao ..... A43B 7/125 36/14
2007/0227044 A1 * 10/2007 Maxson ..... A43B 1/0027 36/44
2008/0040952 A1 * 2/2008 Celia ..... A43B 1/0045 36/3 B
2008/0098617 A1 * 5/2008 Garrett ..... A43B 1/0045 36/11.5
2008/0220065 A1 * 9/2008 Gelvin ..... A43B 1/0045 424/486

(56) References Cited

U.S. PATENT DOCUMENTS

2008/0229612 A1* 9/2008 Sommer ..... A43B 1/0045 36/44
2008/0271340 A1* 11/2008 Grisoni ..... A43B 7/142 36/43
2009/0107007 A1* 4/2009 Keating ..... A43B 1/0045 36/43
2009/0205222 A1* 8/2009 McLinden ..... A43B 1/0045 36/92
2009/0282705 A1* 11/2009 Trigillo ..... A43B 7/142 36/3 B
2009/0313852 A1* 12/2009 Davenport ..... A43B 17/105 36/44
2010/0031532 A1* 2/2010 Bass ..... A43B 17/105 36/44
2010/0050480 A1* 3/2010 Polegato Moretti ..... A43B 9/02 36/3 B
2010/0205831 A1* 8/2010 Cheskin ..... A43B 1/0009 36/44
2011/0047815 A1* 3/2011 Asquith ..... A43B 17/105 36/15
2011/0283562 A1* 11/2011 Shrum ..... A43B 17/006 36/44
2012/0151804 A1* 6/2012 Polegato Moretti ..... A43B 7/06 36/25 R
2012/0167899 A1* 7/2012 Dorsey ..... A43B 1/0045 128/894
2012/0266494 A1* 10/2012 Ko ..... A43B 7/087 36/84
2014/0245631 A1* 9/2014 Joseph ..... A43B 1/0027 36/44

OTHER PUBLICATIONS

"Fungus of the Feet and Nails" Medscape Web. Acccessed Mar. 30, 2016. http://www.medscape.com/viewarticle/807034_2.*

"Gold Bond—Children's Medicated Baby Powder" Walgreens Web. Accessed May 5, 2017. https://www.walgreens.com/store/c/gold-bond---childrens-medicated-baby-powder/ID=prod6104736-product?ext=gooPLA_-_Baby&pla&adtype=pla&kpid=sku6093078&sst=4934bf78-f117-42bb-9eff-07149bf1ef39.*

"Johnson's baby powder medicated" Johnson's Baby Web. Accessed May 5, 2017. https://www.johnsonsbaby.com/powder/johnsons-baby-powder-medicated-zinc-oxide-skin-protectant#ingredients.*

* cited by examiner

FIG. 3
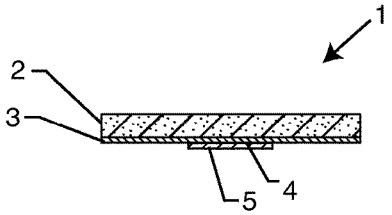
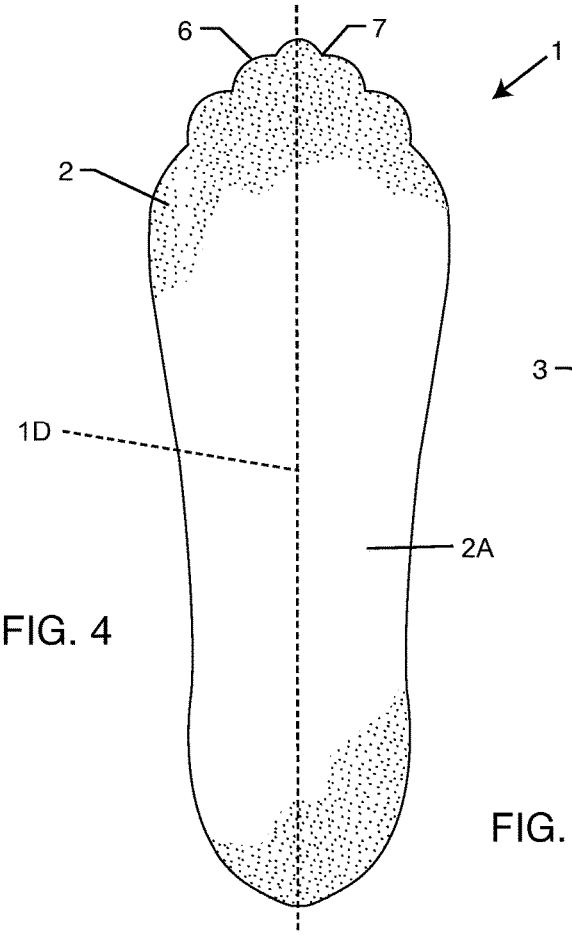
FIG. 4
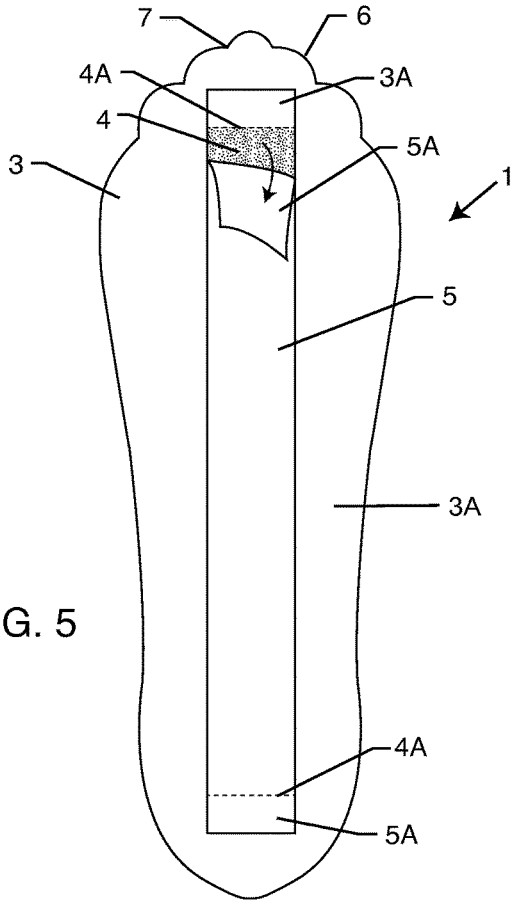
FIG. 5

SHOE LINERS AND METHOD FOR MAKING THE SAME

CROSS-REFERENCE TO RELATED APPLICATIONS

This non-provisional patent application claims benefit and priority under 35 U.S.C.§ 119(e) of U.S. provisional patent application Ser. No. 61/941,322, filed on Feb. 18, 2014, and titled "Shoe Liners and Method of Making the Same," the contents of which are incorporated herein by reference for all purposes.

TECHNICAL FIELD

The field of the invention is insoles or liners for shoes.

Background Art

Short socks, such as PEDS brand socks, are used when wearing women's shoes to absorb sweat. They tend to be unflattering when wearing some styles of women's shoes because they can cover the wearer's toes in the shoes. These socks also can roll down the heel of the foot into the shoe because they are so short. They will become uncomfortable because the wearer has to continually reposition them. Using an insole avoids these problems.

Insoles for shoes provide cushioning for the feet, absorption of moisture such as sweat, and may also combat odor. Examples of patents for insoles that absorb moisture and combat odors include U.S. Pat. No. 5,216,825 to Brum for "Odor Absorbing Contoured Support Inner Sole," U.S. Pat. No. 5,388,349 to Ogden for "Footwear Insole," and U.S. Pat. No. 5,727,336 to Ogden for "Footwear Insole with a Moisture Absorbent Inner Layer." U.S. Pat. No. 7,314,840 to Baychar for "Waterproof/Breathable, Moisture Transfer, Soft Shell Alpine Boots and Snowboard Boots, Insert Liners and Footbeds" discloses a moisture transfer liner with an inner liner and additional layers that include fabrics and/or fleece with anti-microbial and anti-fungal properties.

Disposable insoles, also referred to here as "shoe liners," absorb sweat and reduce the smell of feet. The shoe liners may be replaced each time the shoes are worn. Shoe liners may contain a material that absorbs sweat and combats odor. An example of a patent for shoe liners is U.S. Pat. No. 4,864,740 to Oakley for "Disposable Hygienic Shoe Insole and Method for Making the Same," in which a three-layer insole includes a composite layer sandwiched between an abrasion-resistant top layer and a bottom layer providing friction to maintain the shoe insole in position. The composite layer may contain antimicrobial agents, fragrance, or neutralizer or odor-absorbing agents. U.S. Pat. No. 1,780,574 to Williams for a "Boot and Shoe Sock" provides a permanent rubbed gloss surface and a waterproofed bottom surface on either side of a fibreboard that contains an antiseptic substance. U.S. Pat. No. 3,852,897 to Bridge, et al. for "Footwear" discloses a "shoe insock" especially for use by "people whose feet excessively perspire and/or are unduly odorous," comprising a fibrous web or mat loaded with activated carbon and a binder. U.S. Pat. No. 4,015,347 to Morishita, et al. for "Insoles Effective for Curing and Preventing Athlete's Foot," comprises a metallic layer consisting of silver, copper, or an alloy of the metals on the surface of a base constituting the insole. U.S. Pat. No. 5,392,533 to Gerhartl for "Disposable Shoe Insole and Method for Making the Same" discloses a rigid and durable insole with an absorption layer above a stabilization layer and may include active ingredient capsules containing deodorant and/or bactericide. U.S. Pat. No. 7,037,571 to Fish, et al. for a "Disposable Shoe Liner" discloses a "functional material" sandwiched in pockets formed between a first and a second substrate. The functional material may contain activated carbon granules.

The known insoles or shoe liners are expensive to make and difficult to use. Some are not readily biodegradable. (By "biodegradable" is meant capable of being broken down by the action of living things such as microorganisms into naturally occurring products that do not harm the environment.) The liners generally are not interchangeable from left shoe to right shoe because the liners have top and bottom sides that may not be interchanged by flipping the liners over. The known shoe liners are designed specifically for the right or the left shoe. The known liners also are not easily used with high-heeled shoes.

SUMMARY OF INVENTION

A shoe liner is provided that is easy to use, disposable, biodegradable, and interchangeable for right and left foot shoes, including high-heeled shoes, absorbs sweat, combats odor, and is inexpensive.

Technical Problem

The technical problem addressed by the invention is to provide a biodegradable shoe liner that will effectively absorb sweat and combat odor from the feet of the wearer of the shoes, is inexpensive and disposable. It can be used in either the left shoe or the right shoe, and can be used with high-heeled shoes.

Solution to Problem

A preferred embodiment of the shoe liner according to the invention comprises a first layer made of an absorbent material that is impregnated with a deodorant and a second layer made of a moisture proof material with an adhesive backing. The shoe liner is shaped to fit into shoes for either the left or the right foot, and can be used in high-heeled shoes. A preferred method of making shoe liners according to the invention comprises forming a first layer of cellulose fibers of natural origin, the first layer having a top side and a bottom side, impregnating the first layer with a substance that absorbs moisture, bonding a top side of a second layer to the bottom side of the first layer, the second layer comprising a sheet of a moisture-resistant material and having a bottom side, applying a layer of adhesive to the bottom side of the second layer; and cutting the bonded first and second layers into a shape that can fit into shoes for either the left or the right foot of a person.

Advantageous Effects of Invention

The shoe liner according to the invention is advantageous for use by people whose feet perspire or are unduly odorous. The shoe liner can be worn with bare feet and will absorb sweat while making a comfortable, flattering, sock-less look for the wearer. The shoe liner is inexpensive and easy to make. It is biodegradable and its disposal will not lead to the introduction of antibiotics or metals to the environment. The shoe liner may be worn once (although it could be worn more than once if desired) and disposed of after each wearing. It can be used as a sanitary liner when trying on shoes in department stores in lieu of the sock type nylon currently in use. The liner can be used with either a right or left shoe, and can be used with high-heeled shoes.

BRIEF DESCRIPTION OF DRAWINGS

FIG. 3 is a cross-sectional view of the disposable shoe liner of FIG. 1, taken along the sectional plane 3-3 shown in FIG. 2.

FIG. 4 is an orthogonal view of the top side of the disposable shoe liner of FIG. 1.

FIG. 5 is an orthogonal view of the bottom side of the disposable shoe liner of FIG. 1.

DESCRIPTION OF EMBODIMENTS

Figure 1:
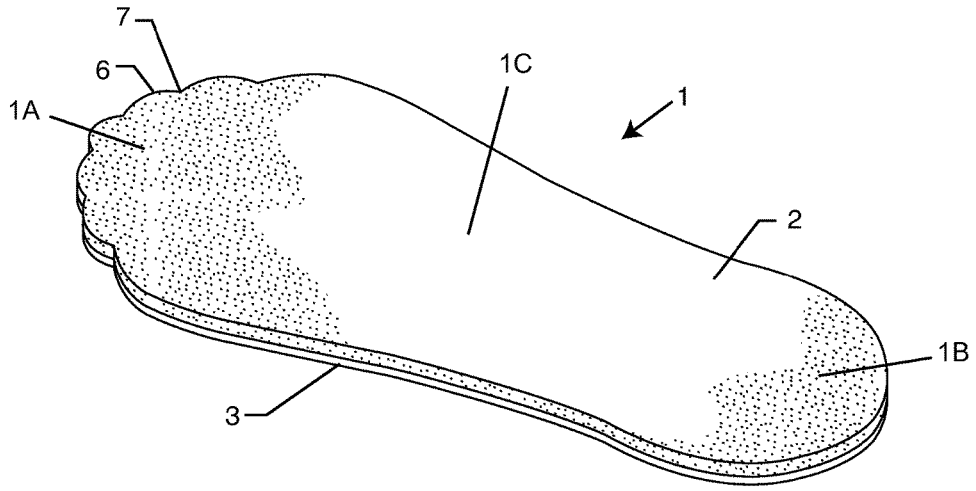
FIG. 1 is a perspective view of an embodiment of a disposable shoe liner according to the invention.
Figure 2:
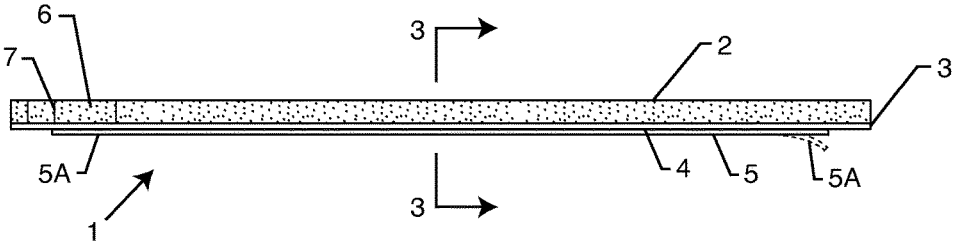
FIG. 2 is an orthogonal view of the side of the disposable shoe liner of FIG. 1.

An embodiment of a shoe liner 1 according to the invention is shown in FIGS. 1-5 and is designed to fit in the shoe of a person (the shoe is not shown in the drawings). The shoe liner 1 is flat and has a front or toe end 1A and a back or heel end 1B joined by a middle section 1C that narrows from the toe end 1A to the heel end 1B (see FIG. 1). The shoe liner 1 preferably has a shape or outline that is generally bilaterally symmetric about a midline 1D running between the toe end 1A and the heel end 1B (see FIG. 4). This symmetry permits the shoe liner 1 to be used in a shoe for the right foot or in a shoe for the left foot, provided the outline of the shoe liner 1 is sufficiently narrow. The shoe liner 1 may be narrower than a person's foot, that is, not as wide as the person's foot, so the shoe liner 1 can fit into either a right or left shoe. Experience has shown that the shoe liner 1 is capable of performing its functions of absorbing sweat and preventing odor without extending underneath the entirety of the person's sole.

A first layer 2 is the upper layer in the shoe liner 1. The upper or top side 2A of the first layer 2 is intended to be in contact with the foot of a wearer when the wearer wears a shoe containing the shoe liner 1. A moisture-resistant second layer 3 is connected to the first layer 2 and will be below the first layer when the wearer wears a shoe containing the shoe liner 1. The second layer 3 contains an adhesive backing 4 that will adhere the shoe liner 1 to the foot bed or insole of the shoe. (The foot bed or insole of the shoe will refer to the surface or portion of the shoe on which the bearer places her foot and is the layer or portion that would be in contact with the foot if not for the intervening shoe liner 1.)

The first layer 2 preferably comprises a compressed non-woven fibrous material. Compressed cotton batting is preferred. Other fibrous materials such as bamboo or wood pulp might be employed. The fibrous material should be inexpensive and biodegradable. The compressed non-woven fibrous material is impregnated with a deodorant and an absorbent substance. Cornstarch and baby powder are preferred absorbent substances. An infusion of a pleasant smelling substance such as perfume or cologne may be incorporated into the first layer 2.

The second layer 3 is made of a sheet of moisture resistant material. Parchment paper is preferred for the sheet of moisture resistant material. The second layer 3 preferably is adhered to the first layer 2 using a suitable adhesive material such as the 3M Company's Super 77 spray adhesive.

The second layer 3 is to be temporarily adhered to the insole of the shoe. It will have a third layer 4 made of adhesive coating the lower or bottom side 3A that is opposed to the side of the second layer 2 that is adhered to the first layer 2. The adhesive should be "tacky" or slightly sticky or adhesive in order to prevent the shoe liner 1 from slipping in the shoe or detaching from the foot bed of the shoe but not so adhesive that the wearer may not easily remove the shoe liner 1 from the foot bed of the shoe. The adhesive of the third layer 4 should not leave a residue on the foot bed of the shoe and preferably should be biodegradable. An adhesive having a tacky quality such as that used for POST-IT® notes is preferred. U.S. Pat. No. 3,691,140 A to Spencer F. Silver describes an adhesive of the requisite tackiness and its disclosure is incorporated by reference.

The third layer 4 need not cover the entire bottom side 3A of the second layer 3. The third layer 4 preferably covers a strip about one-half inch wide running between the toe and heel ends of the second layer 3. The third layer 4 is shown in FIG. 3 and most clearly in FIG. 5. The longitudinal ends (ends closest to the heel and toe) of the third layer 4 are indicated by the lines 4A.

The protective sheet 5 should cover the third layer 4 in order to prevent the third layer 4 from adhering to anything but the protective sheet 5 until the protective sheet 5 is removed. The protective sheet 5 may be sized so as to extend beyond the lines 4A that indicate the ends of the third layer 4 so that the wearer may readily grasp the ends or tabs 5A of the protective sheet 5 in order to peel the protective sheet 5 away from the third layer 4. As shown in the drawings, the protective sheet 5 extends past the third layer 4, forming ends or tabs 5A that overlie sections 3A of the bottom of the second layer 2. (One end or tab 5A is sufficient.) The wearer can easily separate the ends or tabs 5A from the second layer 3, because no adhesive will connect the ends or tabs 5A to the sections 3A of the bottom side of the second layer 3. It will be understood that the protective sheet 5 preferably is one sheet and that the ends or tabs 5A are its ends. The protective sheet 5 should stick to the third layer 4 to prevent that layer from adhering to anything else but should be readily separated by the wearer from the third layer 4. A biodegradable material, such as paper, is preferred for the material of the protective sheet 5.

The first layer 2 and the second layer 3 preferably are cut so as to have the same shape or outline, which should be a neutral or symmetric one as noted earlier that permits the shoe liner 1 to be inserted into the shoe for either a left or a right foot while keeping the first layer 2 uppermost. FIG. 4 shows one such shape for the shoe liner 1. Providing a single shape (albeit of different sizes) reduces the necessity of creating left and right foot versions of the shoe liner 1 and reduces the expense and complexity of making and packaging the shoe liner 1. An identical pair of shoe liners 1 will be all that is needed for a person with two feet and a person with a single foot needs just one.

The shoe liner 1 preferably will be provided in small, medium, and large sizes. This range of sizes should fit the majority of women or men. Women or men with smaller feet may have to trim the small size. Women or men with larger feet can use the large size because, as mentioned above, the shoe liner does not have to cover the entire insole of the shoe to be effective for its intended purposes. The neutral shape or outline of the shoe liner 1 can be fitted into a variety of shoes including high-heeled shoes.

The outline of the toe end 1A of the shoe liner 1, the portion that will go into the toe end of the shoe, preferably is shaped to have arcurate protrusions or petals 6 separated by indentations 7 defined in the toe end 1A of the shoe liner 1. The petals 6 and the indentations 7 are shown in FIGS. 1, 4, and 5. This outline allows the shoe liner 1 to fit shoes with a variety of toe shapes, from narrow to blunt, by permitting the petals 6 of the forward or toe end of the shoe liner 1 to curl up or move together as needed, much as the toes of a person's foot can curl up or move towards each other in a tightly fitting shoe.

The shoe liner 1 is used as follows. The shoe liner 1 should be chosen to have a size that will fit in the shoe. Alternatively, the shoe liner 1 may be cut to fit the shoe. Scissors may be used to trim the shoe liner 1, preferably at the rear or heel end of the shoe liner 1. The wearer removes the sheet 5 in order to expose the adhesive layer 4 on the bottom side of the second layer 3. The wearer inserts the shoe liner 1 into the wearer's shoe so the adhesive layer 4 contacts the insole of the shoe. After use, the wearer may remove and throw away the shoe liner 1. The wearer may then apply fresh shoe liners 1 in the shoes.

The method of making the shoe liner 1 is now described. A first layer 2 of the shoe liner 1 preferably is made of cellulose fibers of natural origin by an air-laid process. The preferred method of making the first layer 2 comprises the following steps: a) forming an essentially uniformly thick, dry fiber layer from loose fibers having a low moisture content that is in the range of residual moisture, the fiber layer exhibiting a thickness; b) embossing the fiber layer to obtain a fibrous web and forming an embossed pattern with compressed fiber bond zones in which the fibers are essentially interconnected and self-bonding, while preserving the thickness of the fiber layer. The first layer 2 has a top side and a bottom side corresponding to the sides that will be uppermost and lowermost when the shoe liner 1 is inserted into a shoe. The top side 2A will be in contact with the wearer's foot and the bottom side will be opposed to the top side 2A.

The first layer 2 is impregnated with a substance that absorbs moisture. The substance that absorbs moisture preferably is a biodegradable substance such as cornstarch or baby powder. An infusion of a pleasant smelling substance such as perfume or cologne may be impregnated into the first layer 2.

The second layer 3 is connected to the first layer 2, preferably by adhering a top side of the second layer 3 to the bottom side of the first layer 2 with an adhesive material such as the 3M Company's Super 77 spray adhesive so that the top side of the second layer will be adhered to the bottom side of the first layer 2. The top side and the bottom side 3A of the second layer 3 correspond to the sides that will be uppermost and lowermost when the shoe liner 1 is inserted into a shoe.

A strip of adhesive 4 will be applied to the bottom side 3A of the second layer 3 preferably in a strip, preferably not wider than one-half inch vertically from the top of the second layer 3 to the bottom side 3A of the second layer 3. An overlapping protective sheet 5, preferably made of paper, is attached to the adhesive backing to prevent the shoe liners 1 from sticking together or to other objects such as the packaging when packaged.

The first layer 2 and the second layer 3 each preferably will be formed as sheets and adhered to each other as described. The preferred shape or outline of the shoe liner 1 will be formed by cutting it out of the adhered sheets, such as by stamping or punching with a die having the preferred shape. In mass production a number of shoe liners 1 may be cut out of the adhered sheets by repetitive stamping or punching with the die. The strip of adhesive 4 with superimposed protective sheet 5 may be applied to the bottom side of the second layer 3 either before or after the cutting step.

While the invention has been described in conjunction with the preferred embodiment, it will be understood that it is not intended to limit the invention to this embodiment or its particular manner of construction, materials or components. On the contrary, the invention is intended to cover alternatives, modifications and equivalents that may be included within the spirit and scope of the invention as defined by the appended claims.

What is claimed is:

1. A disposable shoe liner for a shoe to be worn by a person;

the shoe liner capable of being inserted into either a left or right version of the shoe and above an insole of the shoe, wherein the shoe liner comprises:

a first layer forming a top layer of the shoe liner wherein the first layer is adapted to come in contact with a foot of the person, the first layer being made of a sheet of absorbent material impregnated with a substance that absorbs moisture, a second layer comprising a sheet of a moisture-resistant material below the first layer, a third layer comprising tacky adhesive attached to the second layer on a side of the second layer opposed to the side of the second layer adjacent to the first layer, wherein the first layer, the second layer, and the third layer are made of materials that are biodegradable.

2. The shoe liner according to claim 1 wherein the shoe liner is sized to be capable of fitting into a high-heeled shoe.

3. A disposable shoe liner for a shoe to be worn by a person;

the shoe liner having a toe end and a heel end joined by a middle section, and an outline generally symmetrical about a midline running between the toe end and the heel end of the shoe liner and capable of being inserted into either a left or right version of the shoe and above an insole of the shoe, wherein the shoe liner comprises:

a first layer forming a top layer of the shoe liner wherein the first layer is adapted to come in contact with a foot of the person, the first layer being made of a sheet of absorbent material impregnated with a substance that absorbs moisture, a second layer comprising a sheet of a moisture-resistant material connected to the first layer, and a third layer comprising tacky adhesive attached to the second layer on a bottom side of the second layer opposed to the side of the second layer adjacent to the first layer; and wherein the first layer, the second layer, and the third layer are made of materials that are biodegradable.

4. The shoe liner according to claim 3 wherein the substance impregnating the sheet of absorbent material of the first layer is selected from the group consisting of cornstarch and baby powder.

5. The shoe liner according to claim 3 wherein the sheet of absorbent material of the first layer comprises cellulose fibers of natural origin.

6. The shoe liner according to claim 3 wherein the sheet of absorbent material of the first layer comprises cotton batting.

7. The shoe liner according to claim 6 wherein the cotton batting is compressed batting material.

8. The shoe liner according to claim 3 wherein the sheet of moisture-resistant material of the second layer is parchment paper.

9. The shoe liner according to claim 3 wherein the third layer is formed as a strip extending along the midline of the bottom side of the second layer.

10. The shoe liner according to claim 3 wherein the toe end of the shoe liner is formed with a plurality of petals separated by indentations formed in the toe end of the shoe liner wherein the petals can curl up or move together so the toe end of the shoe liner can fit into a toe of a shoe.

11. The shoe liner according to claim 3 further comprising a protective sheet disposed over a side of the third layer opposed to the side of the third layer that attached to the bottom side of the second layer, wherein the protective sheet covers substantially all of the third layer in order to prevent the third layer from adhering to other objects and the protective sheet may be removed from the third layer in order to permit the third layer to contact the insole of the shoe and thereby removably secure the shoe liner in the shoe.

12. A disposable shoe liner for a shoe to be worn by a person, the shoe liner having a toe end, a heel end, and a middle section, the shoe liner having an outline bilaterally symmetrical about a midline running between the toe end and the heel end, and capable of being inserted into either a left or right version of the shoe and above an insole of the shoe, the shoe liner comprising:

a first layer forming a top layer of the shoe liner wherein the first layer is adapted to come in contact with a foot of the person, the first layer being made of a sheet of absorbent material impregnated with a substance that absorbs moisture, a second layer comprising a sheet of a moisture-resistant material adhered to the first layer, a third layer comprising tacky adhesive in the form of a strip attached to the second layer on a bottom side of the second layer, and a protective sheet disposed over a side of the third layer opposed to the side of the third layer that attached to the bottom side of the second layer, wherein the protective sheet covers substantially all of the third layer in order to prevent the third layer from adhering to other objects and the protective sheet may be removed from the third layer in order to permit the third layer to contact the insole of the shoe and removably secure the shoe liner in the shoe, and wherein the first layer, the second layer, the third layer, and the fourth layer are made of materials that are biodegradable.

13. The shoe liner according to claim 12 wherein the toe end of the shoe liner is formed with a plurality of petals separated by indentations wherein the petals can curl up or move together so the toe end of the shoe liner can fit into a toe of a shoe.

* * * * *